US005255645A

United States Patent [19]

Templeton

[11] Patent Number: 5,255,645

[45] Date of Patent: Oct. 26, 1993

[54] ROTARY VALVE FOR AN INTERNAL COMBUSTION ENGINE

[76] Inventor: George W. Templeton, P.O. Box 424, Friendswood, Tex. 77546

[21] Appl. No.: 838,151

[22] Filed: Feb. 18, 1992

[51] Int. Cl.[5] ..... F01L 5/04

[52] U.S. Cl. ..... 123/190.17; 123/190.4; 123/190.8

[58] Field of Search ..... 123/190.4, 190.6, 190.8, 123/190.14, 190.17

[56] References Cited

U.S. PATENT DOCUMENTS

| | | | |
|---|---|---|---|
| 564,576 | 7/1896 | Altham | 123/190.4 |
| 1,540,808 | 6/1925 | Sawtelle | 123/190.6 |
| 1,573,022 | 2/1926 | Wehr | 123/190.8 |
| 1,611,683 | 12/1926 | Schurch | 123/190.6 |
| 1,618,473 | 2/1927 | Porter | 123/190.17 |
| 1,644,907 | 10/1927 | Zahodiakin | 123/190.6 |
| 1,649,235 | 11/1927 | Jones | 123/190 |
| 1,687,473 | 10/1928 | Dugger et al. | 123/190 |
| 1,697,098 | 1/1929 | Wehr | 123/190 |
| 1,700,862 | 2/1929 | Thompson | 123/190 |
| 1,719,116 | 7/1929 | Johnson | 123/190 |
| 1,724,458 | 8/1929 | Davidson | 123/190 |
| 1,924,188 | 8/1933 | Hall | 123/190 |
| 1,927,348 | 9/1933 | Morris | 123/190 |
| 1,971,060 | 8/1934 | Wills | 123/190 |
| 2,116,022 | 5/1938 | Gross | 123/190.6 |
| 2,156,749 | 5/1939 | Baker | 123/190 |
| 2,370,283 | 2/1945 | Baker | 123/190 |
| 2,989,955 | 6/1961 | Dunne | 123/190 |
| 3,730,161 | 5/1973 | Deane | 123/190.4 |
| 3,892,220 | 7/1975 | Franz | 123/190.6 |
| 3,945,364 | 3/1976 | Cook | 123/190.8 |
| 4,007,725 | 2/1977 | Weaver | 123/190 |
| 4,098,514 | 7/1978 | Guenther | 123/190 |
| 4,201,174 | 5/1980 | Vallejos | 123/190 |
| 4,370,955 | 2/1983 | Ruggeri | 123/190 |
| 4,421,077 | 12/1983 | Ruggeri | 123/190 |
| 4,473,041 | 9/1984 | Lyons et al. | 123/190.17 |
| 4,606,309 | 8/1986 | Fayard | 123/190.17 |
| 4,788,945 | 12/1988 | Negre | 123/190 |
| 4,949,685 | 8/1990 | Doland | 123/190.17 |
| 5,095,870 | 3/1992 | Place | 123/190.4 |

*Primary Examiner*—E. Rollins Cross
*Assistant Examiner*—Erick Solis

[57] ABSTRACT

The rotary valve assembly of the present invention employs a rotary valve body member that is rotatably mounted in a cylindrical opening in a valve casing forming the head above a piston. The axis of this opening and the rotary valve are perpendicular to the axis of the piston and its associated cylinder walls. The intake and exhaust ports are openings that pass through the valve casing from its outer edge to the cylindrical opening containing the rotary valve. There is also a cylinder port between the cylindrical opening in the valve casing and the cylinder containing the piston. The rotary valve body has a circular cutout or scoop portion removed therefrom to allow intake gases to flow from the intake port via this cutout into the cylinder port and then into the cylinder. This same cutout also allows gases to pass from the cylinder port into the exhaust system via the exhaust port. The rotary valve is preferably integral with and driven by a shaft mounted in sealed bearings (mounted in the valve casing) and the shaft is in turn driven mechanically by appropriate coupling to or with the crankshaft. There is no metal-to-metal contact between the rotary valve body and the opening in the head and thus, no need for a separate lubrication supply. The cylindrical opening in the head contains a plurality of non-metallic sealing members which contact the rotary valve body. The rotary valve body has spacers on both sides to prevent metal-to-metal contact with the walls of the cylindrical opening.

16 Claims, 4 Drawing Sheets

ROTARY VALVE FOR AN INTERNAL COMBUSTION ENGINE

BACKGROUND OF THE INVENTION

This invention relates to internal combustion engines, and more particularly, relates to rotary valves for internal combustion engines.

Rotary valves have been proposed for use in internal combustion engines for some time. They have certain inherent mechanical advantages compared to the poppet valves which are conventionally used. Spring biased poppet valves have a reciprocating motion, which because of increased inertia during high speed operations may cause operational problems. Stronger springs may be employed to partially alleviate this problem, but this in turn requires more energy to open the poppet valve. The inertia of a poppet valve may be reduced by making the valve lighter, but the valve must have some minimum size and mass to perform its intended functions. More particularly, the valve must have a certain minimum size in order to provide a sufficient cross-sectional flow area, dissipate heat, and withstand mechanical stresses.

In spite of the obvious advantages of rotary motion, as compared to reciprocating motion, especially at high speeds, poppet valves continue to be used almost exclusively. This is believed to be because the rotary valves that have been designed and proposed in the past have shortcomings that are even more serious than those of existing poppet valves.

A principal problem of earlier rotary valves has been an inability to properly seal them. That is, the rotary valve comprises a rotational member which rotates within an opening in a stationary outer metallic support member. The outer support member has ducts and the inner rotatable member has ports (or openings) for selectively enabling and preventing the flow of intake and exhaust gases through the valve, in accordance with the angular position of the inner rotatable member with respect to the outer support member. It is essential to prevent or minimize the leakage of gas between the stationary and rotatable parts of the valve during the times when the valve is closed and to ensure that all the flow is through the intended channel when the valve is open. In order to accomplish this, and in view of unavoidable manufacturing tolerances between the stationary and rotating parts of metallic valves, special seals have been necessary that are often complex and susceptible to failure. This is in contrast with poppet valves in which a portion of the valve head acts as a seal without appreciable sliding and such special seals are unnecessary.

The seals of a rotary valve are subjected to unfavorable and harsh conditions. The engine temperatures are very high and the pressure within the combustion chamber, especially during the power stroke, is also very high. Thus, when intake and exhaust ports are both closed and the precompressed fuel/air mixture is in the process of rapid combustion the seals must contain this pressure in order to transfer the maximum available energy to the piston. Rotary valve designs of the past often have been complicated and often employed metal-to-metal interfaces as part of their seals, which caused rapid seal failures because of overheating or insufficient lubrication on their surfaces.

An additional problem with conventional internal combustion engines, regardless of the type of valve employed, has been the uneven distribution of fuel in the fuel/air mixture from one point to another in the combustion chamber. A relatively small quantity of fuel is mixed with a much larger quantity of air by a process involving aspiration or injection. This fuel/air mixture is introduced at a specific location and must be uniform throughout the volume of the air if a nominal fuel-to-air ratio is to represent a real ratio as opposed to a statistical average at each point in the combustion chamber. Various designs have been employed in an effort to realize this objective, but the objective remains elusive.

However, rotary valves also provide an open, unobstructed flow path into and out of the combustion chamber, which greatly improves the flow efficiency of fuel vapors and exhaust. In addition, rotary valves also require less energy to operate than poppet valves, increasing the available energy output of the engine.

In spite of the significant potential advantages of a rotary valve internal combustion engine, they have not been widely used commercially. This is largely because rotary valves tend to leak if they are loose enough to permit free rotation and seize if they are tight enough to contain the combustion pressures generated in the combustion chamber.

These and other limitations and disadvantages of the prior art are overcome by the present invention, however, and an improved rotary valve for use in an internal combustion engine that eliminates metal-to-metal contact between an inner rotatable member and an outer support member is provided.

SUMMARY OF THE INVENTION

In a preferred embodiment of the present invention, an improved rotary valve assembly for use in an internal combustion engine that eliminates metal-to-metal contact between an inner rotatable member and an outer support member is provided. More particularly, the rotary valve assembly of the present invention employs a solid rotary valve body (or disk-like member), having a single surface passage or circumferential cutout, as an inner rotatable member that is rotatably mounted in a cylindrical opening in a valve casing member as an outer support member, which may form the head at one end of a cylinder. The axis of both this cylindrical opening and the rotary valve body are perpendicular to the cylindrical axis of the cylinder and associated piston. The intake and exhaust ports are openings that pass through the valve casing member from its outer edge to the circumferential portion of the cylindrical opening containing the rotary valve body. A cylinder port connects the circumferential portion of the cylindrical opening to the top of the cylinder containing the piston and may contain an appropriate ignition device.

The rotary valve body has a single cutout or scoop portion removed from a portion of its circumferential surface to allow intake gases to flow from the intake port via this cutout into the cylinder via the cylinder port. The rotary valve body also has one or more balancing holes in the body generally opposite the cutout portion to compensate for the weight removed in making cutout portion. This single cutout in the circumferential surface of the rotary valve body will also allow gases to pass from the cylinder port into the exhaust system via the exhaust port. In this manner, the rotary valve body with the cutout portion alternately connects the intake system with the cylinder port, and the cylinder port with the exhaust system, as a conventional valve system would. The rotary valve body is preferably integral with and driven by a shaft mounted in a pair of sealed bearings appropriately located in the valve casing, and the shaft is in turn driven mechanically by an appropriate coupling to or with the crankshaft or other rotating engine member. The remainder of the mechanical components of the engine, such as the cylinder, piston, block, and crankshaft, may be conventional.

The circumferential portion of the cylindrical opening in the valve casing has four appropriately sized openings that each contain a non-metallic sealing member which presses against the preferably flat circumferential surface of the rotary valve body to provide a seal for the various gases from the exhaust, intake, and combustion chamber ports, and optionally an emission control port. In addition, the rotary valve body has non-metallic spacers or sealing disks on both sides to prevent metal-to-metal contact with the radial portion of the walls of the cylindrical opening. In this manner the rotary valve body does not directly contact the surface of either the circumferential or radial portion of the cylindrical opening in the valve casing. Thus, there is no metal-to-metal contact between the rotary valve body and the cylindrical opening in the valve casing. This prevents seizing up the problems associated with some earlier rotary valve designs. Because of this lack of metal-to-metal contact, the rotary valve body requires no separate lubrication system for lubricating the surfaces between valve body and valve casing, in contrast to most of the earlier prior art rotary valve designs (or existing poppet valve camshaft and lifter designs).

It is an object of the present invention to provide a rotary valve for an internal combustion engine that eliminates metal-to-metal contact between its rotatable member and outer support member.

It is an object of the present invention to provide a rotary valve for an internal combustion engine that eliminates the need for a supply of lubricating fluids to this valve member.

Accordingly, these and other objects and advantages of the present invention will become apparent from the following detailed description, wherein reference is made to the Figures in the accompanying drawings.

IN THE DRAWINGS

DETAILED DESCRIPTION

Figure 1:
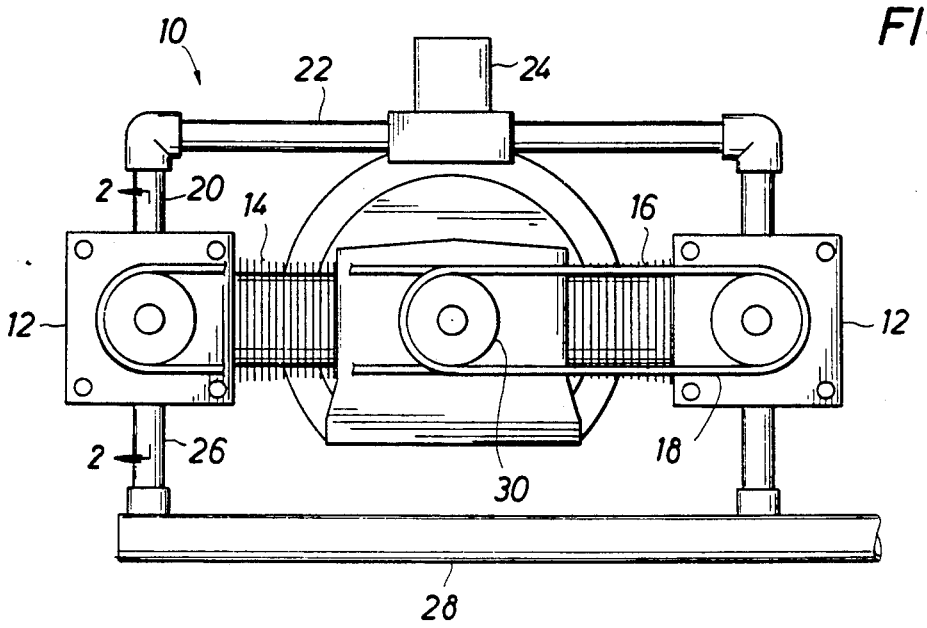
FIG. 1 depicts a front view of an internal combustion engine employing the rotary valve assembly of the present invention.

Referring now to FIG. 1, there may be seen a front view of an air cooled, internal combustion engine 10 of the spark ignition, four stroke cycle design, employing the rotating valve assembly 12 of the present invention. The engine includes two opposed cylinders 14, 16 within each of which a piston is adapted to reciprocate. The rotating valve assembly 12 of the present invention in combination with each cylinder 14, 16 defines, at its head end, a combustion chamber. Although not shown in FIG. 1, the piston is connected to drive a crankshaft through a connecting rod mounted to the piston by means of a wrist pin. (See FIGS. 4–11.) While two opposed cylinders and their associated rotary valve assemblies are illustrated, it should be understood that the invention may be used with an engine of either single or multiple piston design, and of either in-line, flat head, V, or rotary cylinder configuration. In addition, while an air-cooled spark ignition carbureted charge engine operating on a four stroke otto cycle is illustrated, the valve assembly of the present invention may be used with engines operating with fuel injection, or on the diesel cycle of operation, or on a two stroke cycle of operation, or that are water-cooled.

Figure 2:
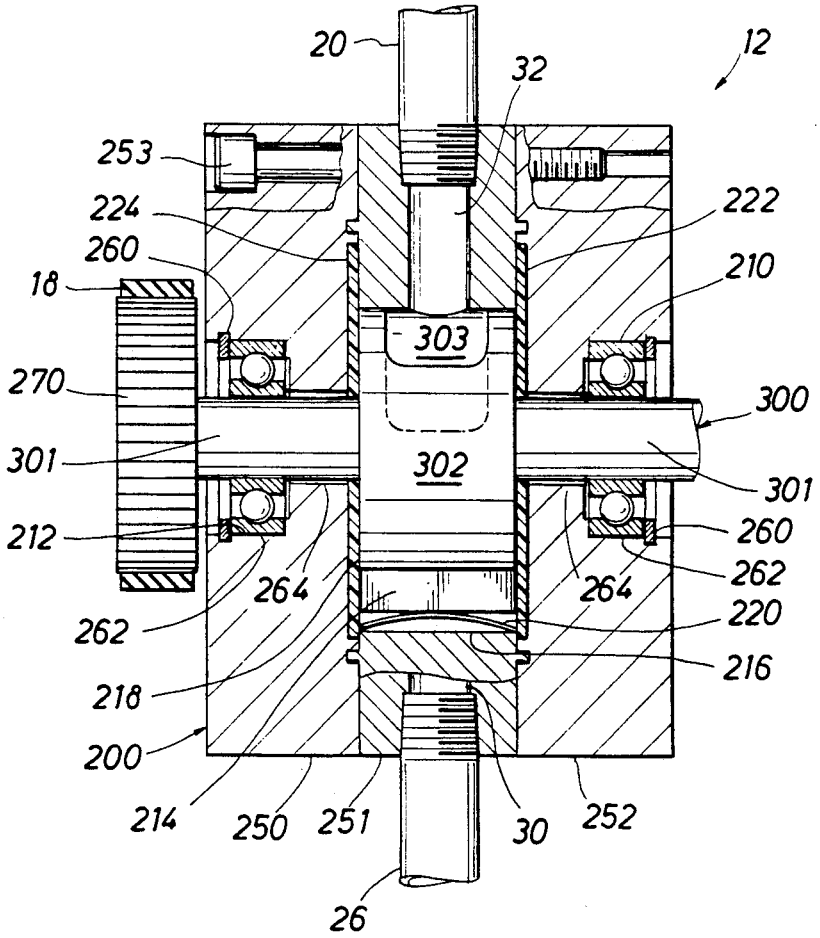
FIG. 2 depicts a partially cross-sectional view of a portion of the rotary valve assembly depicted in FIG. 1.
Figure 3:
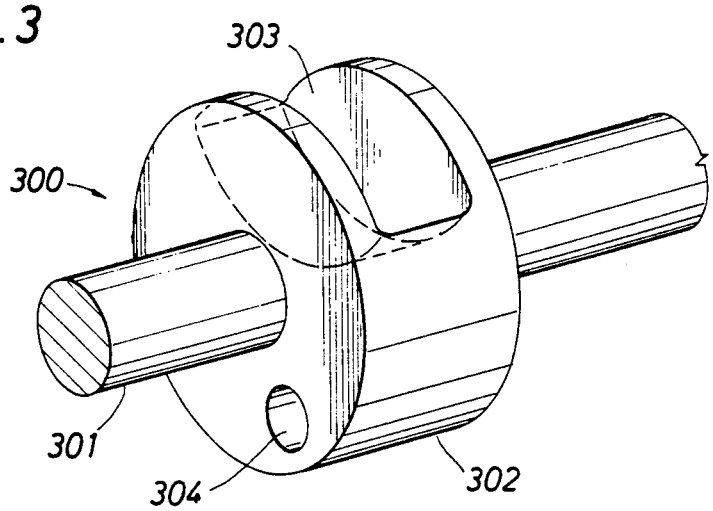
FIG. 3 depicts a three dimensional view of the rotary valve body member of the valve assembly of the present invention.

As depicted in more detail in FIGS. 2 and 3, the valve assembly includes a rotary valve 300 of generally cylindrical configuration 302 having a valve shaft 301, within a valve casing 200 forming a cylinder head, for rotation about the axis of the shaft. The valve shaft 301 is rotatably mounted, at opposing ends of the shaft (or on opposite sides of the valve body), in suitable sealed bearings 210, 212 removably mounted in cavities 262 within the valve casing 200. Where the engine is of an in-line cylinder design, a plurality of these valve assemblies 12 may be mounted above each respective cylinder and via suitable slots and corresponding keys at the ends of their shafts 301, be engaged together to form a single solid drive shaft. The slots and keys are configured to provide the desired timing between the valve body 302 (and associated valve passage 303) and its cylinder and piston.

As shown in FIG. 1, suitable valve drive means, such as, for example, gears, a cog belt or a drive chain 18 is provided to drive the shaft and the rotary valve at preferably one-half the speed of the crankshaft, when the engine is of a four stroke cycle design. An ignition means including an ignition device, such as a spark plug (see FIG. 4), is mounted through a wall of the valve assembly to ignite the combustible charge within the combustion chamber in timed relationship with movement of the piston by suitable voltage distributor means (not shown). An intake port 32 is formed through one side of the valve assembly 12, and this port is in communication with an intake conduit 20 leading from a suitable intake manifold 22 and carburetor 24. (See also FIGS. 2 and 4.) An exhaust port 30 is formed through an opposite side of the valve assembly, and this port is in communication with a conduit 26 leading to a suitable exhaust manifold 28. (See also FIGS. 2 and 4.)

As shown in FIG. 2 (and also FIG. 4) the exhaust 30 and inlet 32 ports are spaced apart and are in planar alignment with each other and the rotary valve member 300, especially the circumferential valve passage 303 in this valve member 300. A rotary valve assembly 12 is provided for each engine cylinder of the engine. Each of the ports and passages are formed with rounded ends and smoothly curved sides to reduce to a substantial minimum the resistance which it offers to the flow of gases or vapors. The ports and passages should be large enough to avoid any undue restriction of the gases flowing through them.

In general, the size of the ports and associated conduits are dictated by the same considerations as for the inlet and exhaust conduits of a conventionally valved cylinder. Typically, the size of the conduit for the exhaust is larger than that of the inlet and may be so employed with the valve assembly of the present invention. Similarly, the volume of the cutout or passage is dictated by considerations of economy versus power and the size of the cylinder. For normally aspirated engines, this volume is from about one third (or one fourth) of the cylinder volume to about the same volume as the cylinder volume.

The circumferential surface of the rotary valve is sealed by means of a plurality of spring-loaded seals 214 seated in appropriate openings 216 formed about the circumference of the opening 218 in the valve casing member 200 containing the rotary valve 300. There must be at least two such seals, one on either side of the port connected to the engine cylinder; preferably, three such seals in a triangular arrangement are employed when no exhaust emission port is employed. Only one such seal is depicted in FIG. 2. As may be seen from FIG. 2, the spring 220 is a simple "bow" spring, although other types or shapes of springs may be employed. The seal 214 itself is a rectangular piece of teflon, although other types of high operating temperature, self-lubricating polymers or other materials may be so employed. The seal 214 rides against the preferably flat circumferential edge of the rotary valve body 300. The edges of the cutout 303 (discussed later herein) in the rotary valve body 300 should be smooth, preferably hand polished, to avoid nicking, cutting or otherwise removing pieces from the surface of the seal member 214.

The size of the seal 214 (thickness or width and depth or height, since the length is determined by the width of the rotary valve), must be sufficient to (physically) withstand the pressures of combustion without physically breaking apart and varies with the brittleness of the polymer or other material employed as the seal material. The polymer or other material brittleness may increase with any increase in maximum operating temperature. The material employed in a prototype engine (described later herein) was obtained from Century Plastics in Houston, Tex., and was called "Virgin Teflon ®."

In addition, non-metallic disks or spacers 222, 224 centered on the valve shaft 301 are provided on both sides of the rotary valve body 302 to prevent any metal-to-metal contact between the radial portion 302 of the rotary valve body 300 and the radial portion of the walls of the opening 218 in the valve casing. These disks 222, 224 are also preferably teflon, or some other similar high-operating temperature, self-lubricating polymer or other material. For the prototype engine, the discs 222, 224 were made from the same polymer as the seal 244, as noted above. The thickness of the discs are such as to withstand the pressures of combustion without failure and the width of the opening 218 is designed to slightly compress (by a few thousandths of an inch) each disc against the sides of the rotary valve body 300. The discs 222, 224 together with seals 214 prevent the escape of any combustion pressure from the cylinder during operation of the cylinder. That is, the discs 222, 224 provide a "side" seal and the seals 214 provide and "end" seal. The outer radius of the discs 222, 224 extends beyond the outer radius of the rotary valve member 302 to ensure no metal-to-metal contact between the rotary valve member and the sides of the opening 218 in the valve casing 200, i.e., at the "sides" of the rotary valve member 302. The outer radius of the discs 222, 224 may extend beyond the radius corresponding to seals 214 and their associated containing or mounting cavities.

As shown in FIG. 2, the generally cylindrical rotary valve body 300 is rotatably mounted in an appropriately sized generally cylindrical opening 218 formed within the valve casing 200 and by means of the bearings 210, 212, disks 222, 224 and seals 214 in a low frictional manner. There is no metal-to-metal contact between the rotary valve body 300 and the cylindrical opening 218 in the valve casing 200. This prevents the seizing up problems associated with earlier rotary valve designs. Because of this lack of metal-to-metal contact, the rotary valve body requires no separate lubrication system for lubricating the surfaces between valve body and valve casing, in contrast to most of the earlier prior art rotary valve designs, or existing poppet valve camshaft and lifter designs.

The valve casing 200 may be formed of three parts 250, 251, 252, which may be interconnected by bolts, or other suitable fasteners 253. Alternatively, the valve casing 200 may be made from two parts (not depicted). The valve body 300 is rotatably mounted by means of having its shaft 301 mounted in a pair of roller bearings 210, 212, each bearing containing an end of the shaft 301 of the rotary valve body 300. The sealed roller bearings 210, 212 are removably contained (by means of conventional snap rings 260 or other removable containing means) in cavities 262 about the shaft opening 264 in the valve casing 200. The bearings 210, 212 are sized to frictionally fit on the shaft 301 and the opening 262 in the valve casing 200 for the bearing 210, 212 also is sized to provide a frictional fit.

As is shown in FIG. 2, fixedly attached to one end of the shaft 301 of the rotary valve body 300 is a drive gear 270. This gear 270 is fixedly secured to the shaft 301 by means of an appropriate fastener (not depicted). The gear is sized to rotate at half the speed of the crankshaft, which is typically the same rotational speed of camshafts for conventional poppet valve engines. A rotational speed other than half crankshaft speed is possible if desired, by merely changing the size or teeth of the gear. This half speed arrangement is presently universally used and understood for valve gear operations on four cycle engines. A cog belt 18 operatively connects with the drive gear 270; this cog belt 18 is also connected to the crankshaft, as depicted in FIG. 1, via drive gear 30.

A valve passage (or cutout or scoop) 303 comprising an outwardly facing concaval recess is formed in the preferably flat circumferential surface of the rotary valve body 300. The passage 303 extends generally in a plane normal to the axis of the rotary valve body's shaft and is centrally positioned between the circumferential edges of the rotary valve body 300 so that the passage moves successively into and out of register with the ports and the combustion chamber. The passage extends across a cord of the outer periphery of the rotary valve body. The cord angle Θ is relatively large so that the flow volume of intake and exhaust gases is large, and also so that valve opening duration is relatively long for good intake breathing and exhaust scavaging. The particular cord angle Θ which is provided will vary according to the design specifications and requirements to achieve any desired amount of valve duration, and to achieve any desired amount of valve overlap. In the embodiment illustrated in the Figures, the angle Θ is shown as 90°. There is no valve overlap in this configuration since, with the valve rotated so that the passage faces downwardly at the close of the exhaust phase and at the start of the intake phase the opposite ends of the passage are in-between the edges of the openings of these two ports (see FIG. 10). It should be noted that while the piston is at top-dead center (or bottom-dead center), the piston does not move while the crankshaft continues to rotate; thus, although the piston is not moving, the valve passage continues to rotate.

The valve casing of FIG. 2 has a cylindrical valve opening or chamber which is connected by a port (not shown) with an engine cylinder (see also FIG. 4) and is provided on opposite sides of the cylinder port with an intake port 32 and an exhaust port 30, respectively. Although depicted in FIGS. 4–11, the use of an emission control port 400 may be optional. Rotatably mounted within the valve chamber 218 is a rotary valve body member 300 having a peripheral or circumferential passage 303 therein. The valve member 300 is rotated, preferably from a moving part of the engine, in timed relation to the movements of the piston 401 so that this passage 303 will be in operative relation to the cylinder port 402 during the cycle of operation of the engine, and the ports (30, 32, 400, 402) leading to and from the valve chamber 218 are so arranged that the rotary movement of the rotary valve body member 300 while each port is in an operative relation to the cylinder port 402 will cause the cylinder port 402 to be first connected with the intake port 32 during the suction stroke of the engine piston, then disconnected from both the intake 32 and the exhaust 30 port during the compression and power strokes of the piston, and then connected with the exhaust port 30 during the exhaust stroke of the piston. In this manner, the circumferential passage 303 in the rotary valve body 300 serves to control the intake and exhaust to and from the engine cylinder (and optionally an emission control system) during one complete operation of the engine piston. The several parts of the valve mechanism may take various forms and may be operated in various ways, and it will be understood that the particular embodiment of the invention depicted here has been selected only for the purposes of illustration.

In the particular embodiment of the invention illustrated in FIG. 2, the valve assembly 12 comprises a valve casing 200 having a longitudinal cylindrical chamber, or bore, 218 extending lengthwise thereof, and is preferably divided along a vertical plane into three sections (250, 251, 252), each of which may contain an appropriate portion of the valve chamber 218. The central section 251 (with one type of cross-hatching) contains the large diameter cylindrical chamber 218 for containing the rotary valve body 302, while the two outside sections 250, 252 (with a different type of cross-hatching) contain smaller cylindrical chambers 264 for containing the shaft 301 of the rotary valve body 300 (and the cavities associated with the shaft bearings 262). The sections of the valve casing may be removably mounted together via bolts on other fasteners 253 (one bolt 253 is depicted in partial cross-section). The sections of the valve casing which are indicated in FIG. 2 may, if desired, be removably mounted, via appropriate bolts or other fasteners 280 (not depicted), on the top of the cylinder or cylinders with which it cooperates, as shown in FIG. 1. In addition, the three sections of the valve casing 200 are preferably provided with suitable guide pins and holes to ensure proper alignment during assembly. Preferably, the center section 251 of the valve casing 200 has a circular sealing protrusion or rib extending from the sides which abut the other sections 250, 252 which then engages in corresponding openings in the outer two sections 250, 252 of the valve casing 200. The valve casing parts are preferably made from aluminum, or any other easily machinable metals with good heat transfer properties. For the prototype engine, 6042 Aluminum square stock (6 inch by 6 inch) from Jorgenson Steel in Houston, Tex., was employed to make the valve casing. Sections were sawed off and then machined to make a three piece valve casing. This is a relatively high grade of Aluminum, but other grades may be employed after appropriate consideration of strength versus the amount of expansion from the heat of combustion. However, the valve casing parts may be water cooled, as well as air cooled as depicted in the Figures. For a water cooled casing, appropriate cavities and openings are provided in the valve casing to allow water to remove heat from the valve assembly 12.

Each valve casing 12 is provided with a port 402 leading from the valve chamber 218 (or opening for the rotary valve body) to the cylinder 403 of the engine with which it is associated and is also provided on opposite sides of the cylinder port and spaced relatively short distances therefrom, with an intake port 32 and an exhaust port 30, which communicate respectively with the intake and exhaust manifold of the engine, which are not shown in any detail in FIG. 2, and the valve chamber 218. As depicted in FIG. 3, rotatably mounted within the valve chamber 218 of the valve casing 200 is a rotary valve body member 300 which has a circumferential passage 303 (or recess or peripheral port), with the passage 303 being arranged circumferentially around the rotary valve body member 302. Note that the width of the scoop or port portion 303 of the rotary valve body 302 is of a width that is less than the entire width or thickness of the rotary valve body 302 itself. That is, the scoop 303 leaves untouched a small outer edge of the circumferential portion of the rotary valve body 302 which allows a seal 214 engaging that surface to continue to seal against the outer circumference of the rotor even when the scoop 303 is passing by a seal 214. In addition, the rotary valve body 302, as depicted in FIG. 3, has a cavity 304 or opening(s) generally opposite the passage 303 where material has been removed to rotationally balance the rotary valve body 302 for the material removed to form the passage 303. The rotary valve body 302 and shaft 301 is preferably made from a single piece of mild steel, although other metals that are easy to machine and have good heat transfer properties may be so employed. For the prototype engine, the rotary valve body 302 was made from mild steel obtained from Jorgenson Steel and the cutout was machined by an end mill with the rotary body 302 fixed, after initial machining to size. In general, the metal of the rotary valve body should be different from that employed to make the valve casing to avoid any "galling" by inadvertent metal-to-metal contact.

The valve assembly 12 may be constructed for a single cylinder or for a multiple cylinder engine. The valve assembly construction for a multiple cylinder engine is merely a duplication of that for a single cylinder engine. The valve assembly 12 will now be described as if it were applied to a single cylinder engine. The rotary valve body member 302 (and its passage 303) is rotated in timed relation to the movements of the engine piston 401, which timing is shown in the single cylinder engine of FIGS. 4–11. In FIGS. 4–11, the valve 300 is designed to rotate at one-half the speed of rotation of the engine shaft and will, therefore, complete one complete rotation during each complete operation, of four strokes, of the engine piston. Other rotation speeds may be employed. The rotary valve body 302 may be rotated in any suitable manner and is shown in FIG. 2 as having a shaft 301 projecting beyond the end of the valve casing 200 and provided with a gear 270, which may be connected either directly or indirectly with the engine crankshaft or other suitable operating mechanism.

The ports (32, 30, 400, 402) leading to and from the valve chamber 218 in the valve casing 200 are so arranged with relation one to the other and the rotary valve member's circumferential passage 303 that during each rotation of the valve member 302 the peripheral passage 303 will be in an operative relation to the cylinder port 402 and the movement of the valve through each rotation will cause the cylinder port 402 to be first connected with the intake port 32, then disconnected both from the intake port 32 and the exhaust port 30, and then connected with the exhaust port 30. Optionally, an emission control port 400 is selectively connected as well.

Figure 4:
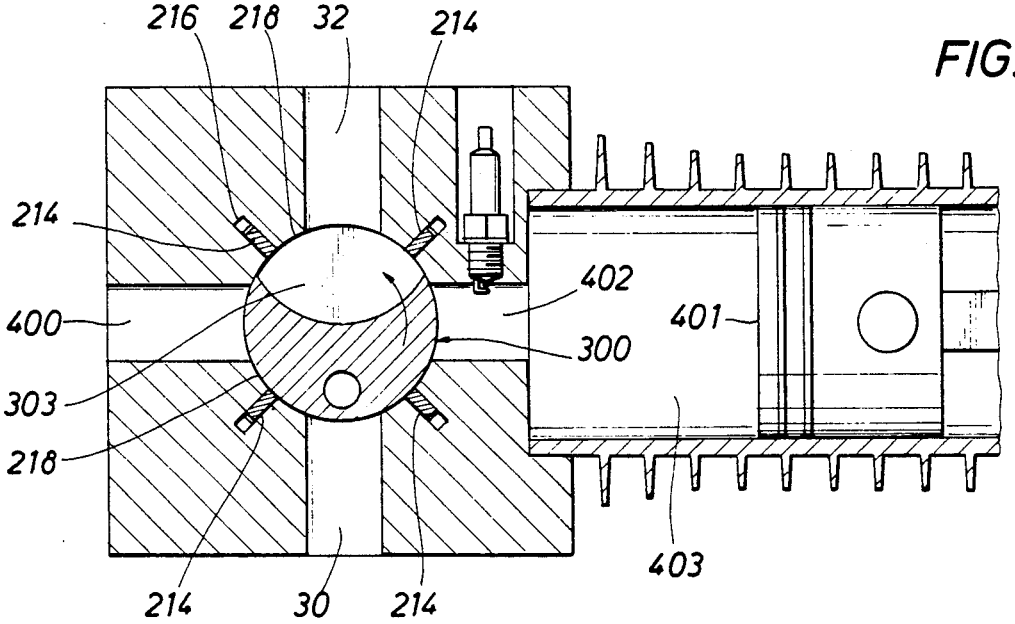
FIG. 4 depicts a simplified cross-sectional view of an internal combustion engine with a single cylinder and rotary valve assembly of the present invention, illustrating a portion of the operating cycle of the engine.

As may be seen in FIG. 4, there are four circumferential seals 214 disposed in appropriate cavities 216 in the circumferential portion of the opening 218 in the valve casing 200, when an emission control port 400 is provided. These are the spring loaded seals 214 discussed earlier herein with reference to FIG. 2. Again, only two such seals (on both sides of the cylinder port 402) are required. If the emission control port 400 is not employed, then a third seal may be located in this general area (the area of port 400) to provide a triangular arrangement of seals. Preferably, such a triangular arrangement is employed to provide "balanced" pressure against the rotary valve body 302 by the seals 214 when no emission port is present.

The seals 214 are disposed to isolate each port (32, 30, 400, 402) of the valve casing 200 from the other ports when not connected by the passage 303 in the rotary valve body 302. The fact that the rotary valve member 300 continues to rotate when the piston 401 is at its bottom-dead center position ensures that the trailing edge of the passage 303 will clear the circumferential seal 214 (between the inlet port 32 and the port to the cylinder 402) before the compression stroke begins.

Figure 5:
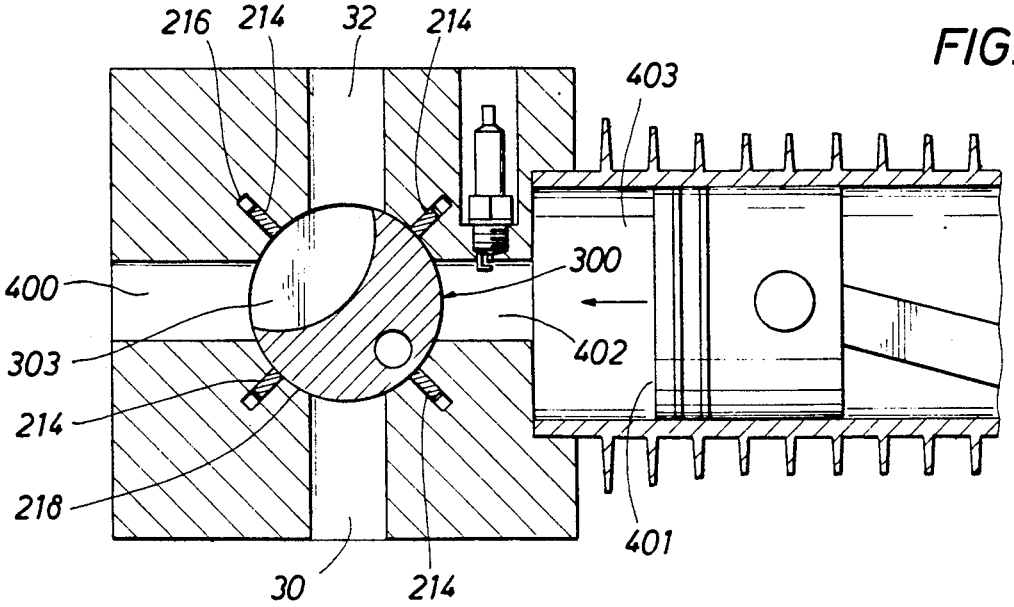
FIG. 5 depicts a simplified cross-sectional view of an internal combustion engine with a single cylinder and rotary valve assembly of the present invention, illustrating a portion of the operating cycle of the engine.
Figure 9:
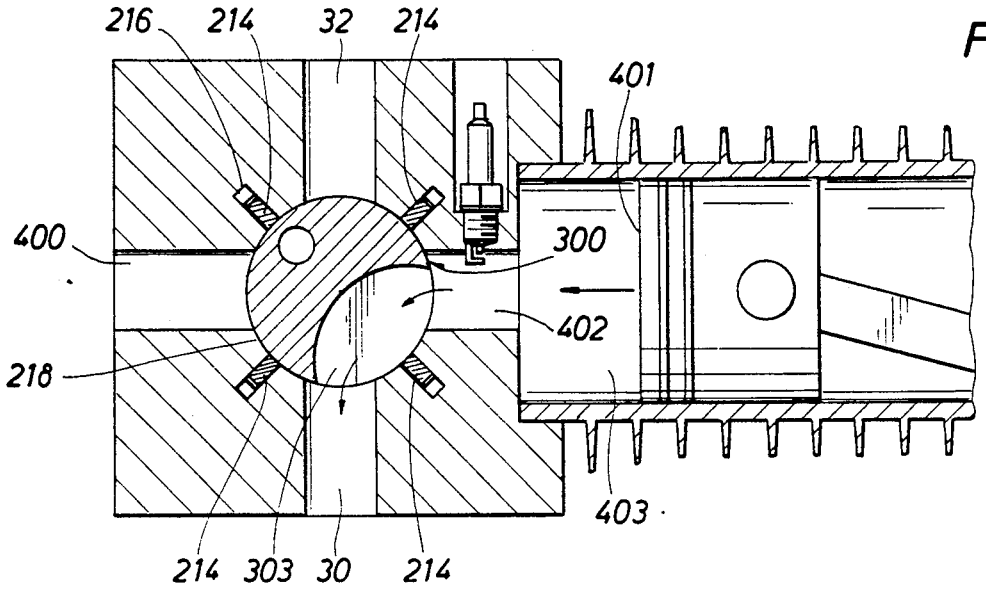
FIG. 9 depicts a simplified cross-sectional view of an internal combustion engine with a single cylinder and rotary valve assembly of the present invention, illustrating a portion of the operating cycle of the engine.

By the time the piston 401 has completed its suction stroke, the rotary valve member 300 will have assumed substantially the position shown in FIG. 4 in which the cylinder port 402 is closed, but the intake port 32 is still in communication with the peripheral passage 303 of the rotary valve member 300. In FIG. 4, the piston 401 is at its bottom dead center position (having just completed the suction stroke) and is ready to begin the start of its compression stroke. During the compression stroke of the piston 401, a flat circumferential edge of the rotary valve body member 300 remains in communication with the cylinder port 402 and the cylinder port 402 is disconnected from the intake port 32 and exhaust port 30, as shown in FIG. 5, by the seals 214 and disks (not shown). At the end of the compression stroke and at the time of ignition, the valve 300 will occupy substantially the position shown in FIG. 6, in which the intake port 32 and exhaust port 30 are still closed. FIG. 7 depicts a portion of the power stroke. It is not until the completion of the power stroke of the piston 401 that the valve member 300 assumes the position shown in FIG. 8, in which it is just ready to open the exhaust port 30. At the beginning of the exhaust stroke of the piston 401, the exhaust port 30 will be opened and thus connected with the cylinder port 402 to permit the escape of the burned gases from the engine cylinder 403, as shown in FIG. 9, and at the end of the exhaust stroke the valve 300 will have again assumed substantially the position shown in FIG. 10 in which the cylinder port 402 is closed and the next succeeding port with which the passage 303 of the rotary valve member 300 is in communication with will be the intake port 32. Upon further rotation of the valve member 300, the intake port 32 will be connected with the cylinder port 402. Just prior to the beginning of the suction stroke of the piston 401, the valve member 300 will occupy substantially the position shown in FIG. 10 in which the intake port 32 will soon be in open communication with the peripheral port 303 of the rotary valve body 302 member and the cylinder port 402 is open to the passage 303. With the beginning of the suction stroke of the piston 401 the movement of the valve member 300 will cause the cylinder port 402 to remain open and to be thus connected with the intake port 32 via the passage 303, as shown in FIG. 11.

It will be noted that the ports (30, 32, 400, 402) all communicate with the valve chamber or opening 218 at approximately 90° angles, with the exhaust 30 and intake 32 ports being approximately 180° apart. Other arrangements of the ports may be employed and still be within the scope of the present invention.

Figure 6:
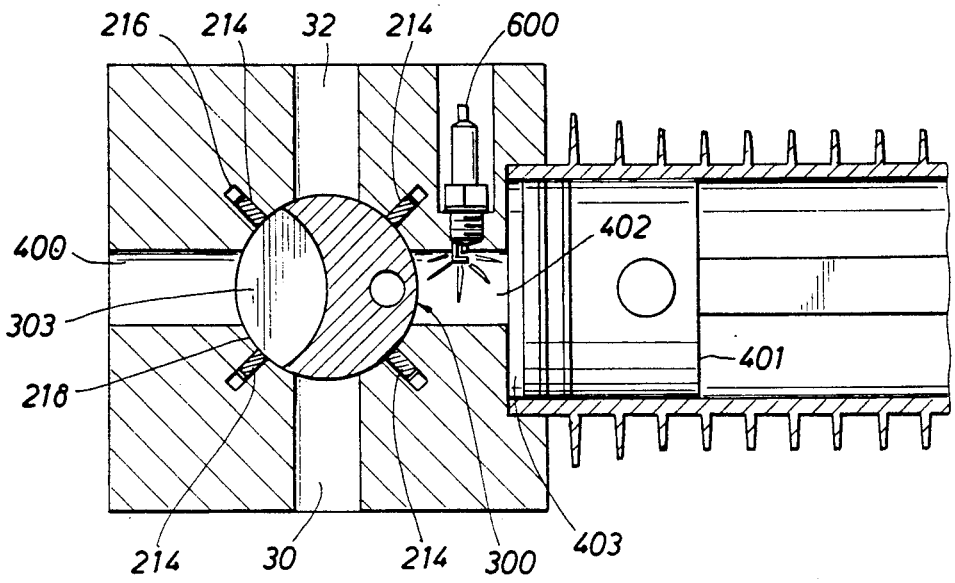
FIG. 6 depicts a simplified cross-sectional view of an internal combustion engine with a single cylinder and rotary valve assembly of the present invention, illustrating a portion of the operating cycle of the engine.
Figure 7:
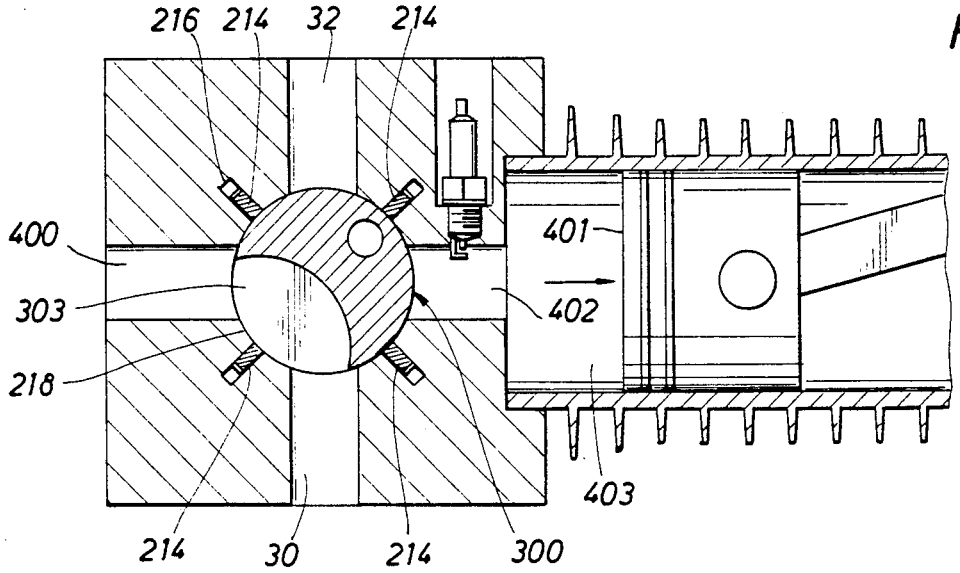
FIG. 7 depicts a simplified cross-sectional view of an internal combustion engine with a single cylinder and rotary valve assembly of the present invention, illustrating a portion of the operating cycle of the engine.
Figure 8:
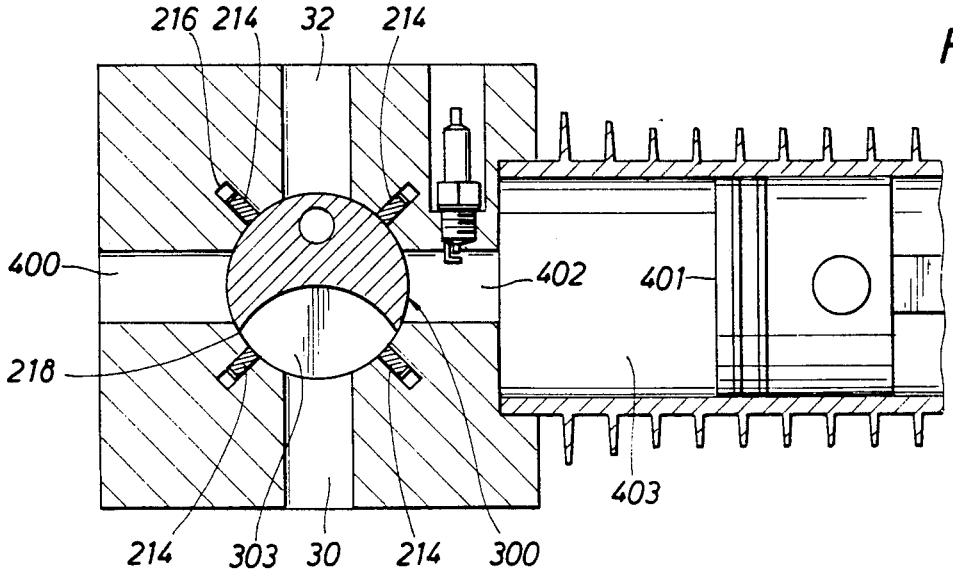
FIG. 8 depicts a simplified cross-sectional view of an internal combustion engine with a single cylinder and rotary valve assembly of the present invention, illustrating a portion of the operating cycle of the engine.
Figure 10:
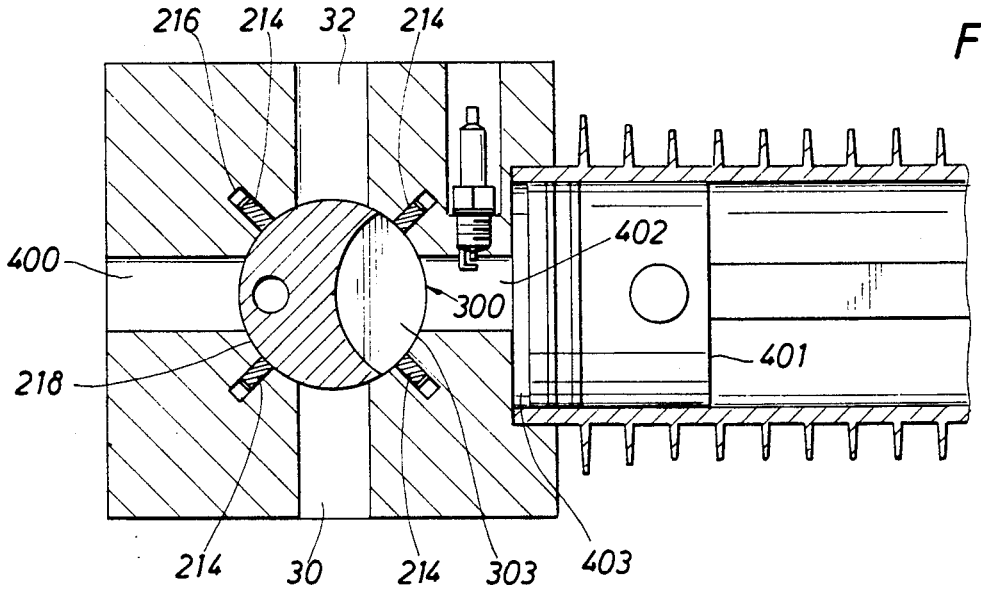
FIG. 10 depicts a simplified cross-sectional view of an internal combustion engine with a single cylinder and rotary valve assembly of the present invention, illustrating a portion of the operating cycle of the engine.
Figure 11:
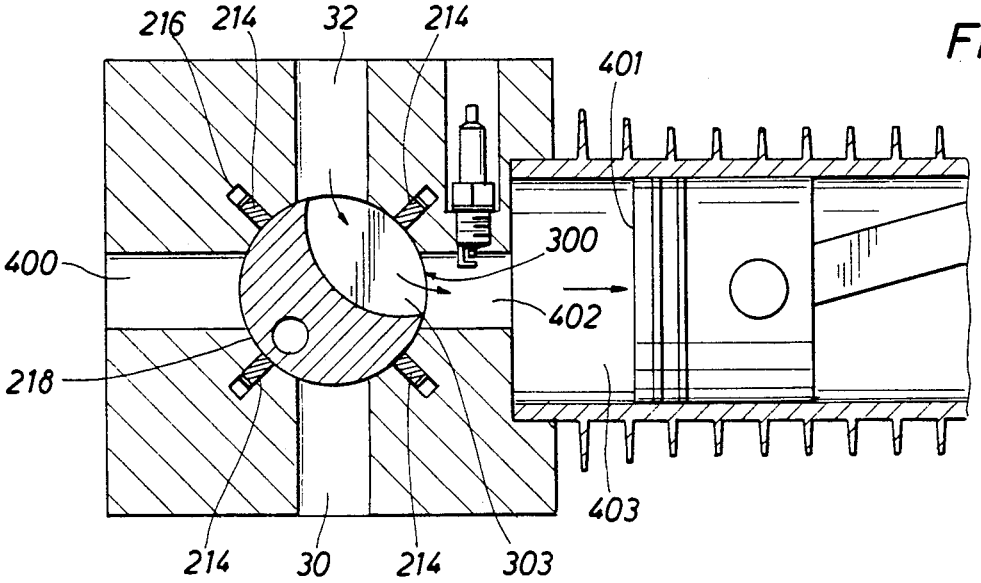
FIG. 11 depicts a simplified cross-sectional view of an internal combustion engine with a single cylinder and rotary valve assembly of the present invention, illustrating a portion of the operating cycle of the engine.

In more detail, it will be assumed that the single cylinder engine of the embodiment depicted in FIGS. 4–11 is to be operated by inducting a charge of fuel/air mixture from a carburetor connected through a manifold to its intake conduit. Assume that the engine's crankshaft is rotating with the rotary valve body 300 turning counter clockwise as viewed in FIG. 4. In FIG. 4 the piston 401 is at its bottom dead center with the rotary valve body passage 303 at the 3:00 position. This position of the elements is at the exact close of the intake phase and start of the compression phase. Continued movement of the piston 401 upwardly toward its top dead center position, shown in FIG. 6, causes the rotary valve body 300 to rotate and carry its passage 303 into simultaneous registry with the intake port 32 and the optional emission control port 400, as shown in FIG. 5. The piston 401 moves upwardly through its compression stroke towards the top dead center position of FIG. 6. During the compression stoke the rotary valve 300 turns to carry its passage 303 to the 12:00 position. The spark plug 600 is then energized (as shown in FIG. 6) to ignite the compressed charge for the start of the expansion phase which drives the piston 401 downwardly toward its bottom dead center position of FIG. 8, with its passage 303 at its 9:00 position. Upward movement of the piston 401 during its exhaust phase causes the rotary valve 300 to carry its passage 303 into simultaneous registry with the exhaust port 30 and the combustion chamber port 402, as illustrated by FIG. 9. FIG. 10 depicts the piston 401 in its top dead center position and marks the start of the intake phase. During the intake phase the fuel/air charge is inducted through the intake port 32 and into the cylinder 403 until the rotary valve 300 turns and moves its passage 303 to close off the port 402 and reaches the 3:00 position. FIG. 11 depicts the intake phase.

With the rotary valve arrangement 12 of the present invention, conventional valve timing may continue to be employed or modified. The exhaust opening can be deferred until near the end of the expansion stroke, or even to a point beyond the end of the expansion stroke. Alternatively, the opening can be opened earlier if desired. Thus, the timing may be adjusted for performance or economy, or optimized for both.

The provision of a single valve 300 with an exterior circumferential passage 303 which controls the flow of both the intake charge and exhaust for a single combustion chamber 403 results in improved efficiency of the valve 300. The exhaust gases which flow through the valve passage 303 when the exhaust port 30 is open transfer heat to the rotary valve body 302, and during the intake phase this heat is transferred to the relatively cooler intake charge inducted through the passage from the intake port 32. Thus, the intake charge is preheated for better atomization and gas mixing, with a resulting higher combustion efficiency. The invention also achieves higher volumetric efficiency by charging the cylinder with a greater volume of fueled air mixture for each stroke, thereby producing a higher compression index and more complete burning of the charge. In addition, because of these features, many different types of alternative fuels may be employed in an engine employing the valve assembly 12 of the present invention. Further, there is a rapid cooling of the hot exhaust gases in the valve passage following the close of the exhaust port 30 as the rotary valve body passage 303 is turning to the 6:00 position of FIG. 10. The contraction of the cooling gases causes a partial vacuum in the volume of the passage 303 which serves to assist in drawing in the intake charge into the combustion chamber 403.

Valve lift duration and valve overlap may be selectively designed in the engine by the choice of the cord angle and volume of the passage for the valve passage. In addition, varied performance may be obtained for the same engine by providing a number of interchangeable valves 300 having passages 303 with different cord angles and/or volumes. In general, a cord angle of about ninety degrees is preferred, although other angles may be employed. The width of the passage 303 should be large enough to provide for "easy" gas flow between the ports (30, 32, 400, 402) and passage 303. The volume of the passage 303 depends upon the volume of the cylinder 403 (as noted earlier herein) and the trade-off between performance and economy. Adjustments may be made in the volume by adjusting the width, cord angle, depth or combinations thereof.

When the valve assembly 12 of the invention is used with an internal combustion engine operating with fuel injection, then a volume of fresh air is trapped within the valve passage 303 and carried across the top of the valve during the compression and expansion strokes. During the exhaust phase with the valve turned to the position of FIGS. 5–7 this volume of fresh air is released and mixed with the exhaust gases to assist in burning residual fuel components in the exhaust manifold and a catalytic converter where the latter is provided.

For conventional emission control a portion of the exhaust gas stream is supplied as part of the intake to reburn (or recombust) this gas stream to provide more complete combustion. This may be accomplished using a conventional emission control vacuum pump and the optional emission control port. The operation of such a conventional emission control system is well-known and will not be discussed herein.

Each piston 401 is connected to a crankshaft in a conventional manner which changes the reciprocating piston movement into a rotative source of power. One end of the crankshaft is connected by an appropriate transmission means to transmit rotative power.

The function of the valve assembly 12 of the invention is to provide a mixture of fuel and air to each of the combustion chambers 403 at the appropriate time and also to affect substantially complete removal of the burned exhaust gases after ignition. This is to be accomplished in the most efficient manner, thereby maximizing the efficiency of the engine and also minimizing the emission of pollutants through the exhaust pipe and into the ambient atmosphere.

The circumferential surface of the rotary valve 300 is sealed by means of a plurality of spring-loaded seals 214 seated in appropriate openings 216 formed about the circumference of the opening 218 in the valve assembly 12 containing the rotary valve 300. One such seal 214 is depicted in FIG. 2. As may be seen from FIG. 2, the spring 220 is a simple "bow" spring, although other types or shapes of springs may be employed. The seal 214 itself is a rectangular piece of teflon, although other types of high operating temperature, self-lubricating polymers or other materials may be employed, that rides against the circumferential edge of the rotary valve body. The edges of the cutout 303 in the rotary valve body 302 should be smooth, preferably hand polished, to avoid nicking, cutting or otherwise removing pieces of the seal surface 214.

In addition, non-metallic disks or spacers 222, 224 centered on the valve shaft 301 are provided on both sides of the rotary valve body 302 to prevent any metal-to-metal contact between the rotary valve body 302 and the walls of opening 218 in the valve casing 200. These disks 222, 224 are also preferably teflon, or some other similar high-operating temperature, self-lubricating polymer. Thus, there is no metal-to-metal contact between the rotary valve body 302 and the cylindrical opening 218 in the valve casing 200. This prevents the seizing up problems associated with earlier rotary valve designs. Because of this lack of metal-to-metal contact, the rotary valve body 300 requires no separate lubrication system for lubricating the surfaces between valve body and valve casing, in contrast to most of the earlier prior art rotary valve designs, or existing poppet valve camshaft and lifter designs. Further, the valve design of the present invention does not have any local "hot" spots and thus may be employed in an engine running on conventional hydrocarbon fuels or alternative types of fuels that are combustible in the engine.

The rotary valve of this invention is not subject to an inertial and structural consideration such as a poppet valve, and therefore open air versus time is only limited by matching the opening of the exhaust or intake of the positions of the rotating valve and the port into the cylinder which may be quite large. Thus, a very rapid discharge of exhaust gases results.

A working carbureted, spark ignition, four cycle, air-cooled, four piston engine employing prototype valve assemblies of the present invention has been constructed and successfully operated. The engine is as depicted in FIG. 1, and is a Volkswagen engine modified by the removal of its heads, poppet valves, and associated valve operating parts (camshaft, rocker arms, tappets, etc.). The engine was built from a number (four) of integral valve assemblies 12 of the present invention, each one for a cylinder of the engine. The valve assemblies 12 of the present invention are employed as the heads and are removably mounted on the cylinders by bolts and nuts. The shafts of the valve assemblies of adjoining cylinders are mechanically coupled together by a slot and flat extension, as noted earlier herein.

Many other variations and modifications may be made in the apparatus and techniques hereinbefore described, by those having experience in this technology, without departing from the concepts of the present invention. Accordingly, it should be clearly understood that the apparatus and methods depicted in the accompanying drawings and referred to in the foregoing description are illustrative only and are not intended as limitations on the scope of the invention.

What is claimed is:

1. A rotary valve for an internal combustion engine, comprising:

an outer stationary support member formed with a hollow interior and containing a plurality of openings therein for passing intake and exhaust gases to said hollow interior, a rotatable inner member having a shaft about which it is rotatable, housed within said hollow interior, having an exterior passage for selectively connecting said openings with at least an opening for a combustion chamber and having material opposite said passage removed to rotationally balance said inner member for material removed to create said exterior passage, bearing means disposed in said outer stationary member for supporting said shaft of said rotatable inner member for rotation, and a plurality of sealing means disposed between the hollow interior of said outer stationary support member and said rotatable inner member.

2. The valve of claim 1, wherein said plurality of sealing means each comprises a non-metallic, low friction member contacting said inner member.

3. The valve of claim 2, wherein said sealing means each include a biasing means for urging said non-metallic, low friction member against said inner member.

4. The valve of claim 2, wherein said low friction member comprises at least a piece of teflon.

5. The valve of claim 1, wherein said opening in said outer support member for said combustion chamber serves as at least a portion of said combustion chamber.

6. The valve of claim 1, wherein said outer member comprises a plurality of interlocking sections.

7. The valve of claim 6, wherein said plurality of sections is three.

8. The valve of claim 7, wherein each of said sections are made of metal.

9. The valve of claim 8, wherein said metal is aluminum.

10. The valve of claim 8, wherein said rotatable inner member is made of metal.

11. The valve of claim 10, wherein said metal is steel.

12. The valve of claim 1, wherein said bearing means comprise sealed roller bearings.

13. An internal combustion engine, comprising:

a cylinder, a valve casing interconnected with said cylinder having a central cylindrical chamber and having an inlet port, an outlet port and a cylinder port connecting said cylindrical chamber with said cylinder, a valve body rotatably mounted in said cylindrical chamber and having an exterior, peripheral port to selectively interconnect said cylinder port with said inlet and outlet ports and having material opposite said peripheral port removed to rotationally balance said valve body for material removed from said valve body to create said peripheral port, a plurality of sealing means positioned between said valve casing and said valve body, and means for cooling said cylinder.

14. A rotary valve for an internal combustion engine comprising:

an outer stationary support member formed with a hollow interior and containing a plurality of openings therein for passing intake and exhaust gases to said hollow interior, a rotatable inner member having a shaft about which it is rotatable housed within said hollow interior and having an exterior passage for selectively connecting said openings with at least an opening for a combustion chamber, bearing means disposed in said outer stationary member for supporting said shaft of said rotatable inner member for rotation, a plurality of sealing means disposed between the hollow interior of said outer stationary support member and said rotatable inner member, and at least one non-metallic disc disposed on said shaft of said inner member between said inner member and said outer member.

15. The valve of claim 14, wherein said disc comprises at least a piece of teflon.

16. A rotary valve for an internal combustion engine, comprising:

an outer stationary support member formed with a hollow interior and containing a plurality of openings therein for passing intake and exhaust gases to said hollow interior, a rotatable inner member having a shaft about which it is rotatable housed within said hollow interior and having an exterior passage for selectively connecting said openings with at least an opening for a combustion chamber, bearing means disposed in said outer stationary member for supporting said shaft of said rotatable inner member for rotation, and a plurality of sealing means disposed between the hollow interior of said outer stationary support member and said rotatable inner member and an opening in said outer support member for an emission control system.

* * * * *